US006006357A

United States Patent [19]

Mead

[11] Patent Number: 6,006,357

[45] Date of Patent: Dec. 28, 1999

[54] SIGNALING GLOVE

[76] Inventor: James E. Mead, 13765 SW. Harness La., Beaverton, Oreg. 97008

[21] Appl. No.: 09/036,707

[22] Filed: Mar. 6, 1998

[51] Int. Cl.[6] ..... A41D 19/00

[52] U.S. Cl. ..... 2/160; 2/905; 359/517; 362/103

[58] Field of Search ..... 2/158, 159, 160, 2/161.6, 163, 167, 905; 362/103; 359/517

[56] References Cited

U.S. PATENT DOCUMENTS

| | | | |
|---|---|---|---|
| 1,165,970 | 12/1915 | Harris | 2/159 |
| 1,244,065 | 10/1917 | Miller | 2/159 |
| 1,520,693 | 12/1924 | Brown | 2/159 |
| 1,630,730 | 5/1927 | Daugherty | 2/159 |
| 1,764,549 | 6/1930 | Caroselli et al. | 2/159 |
| 1,772,305 | 8/1930 | Chamberland | 2/159 |
| 2,092,574 | 9/1937 | Eddy | 2/159 |
| 3,638,011 | 1/1972 | Bain et al. | 2/160 |
| 4,519,781 | 5/1985 | Boyd . | |
| 5,249,106 | 9/1993 | Barnes et al. | 362/103 |
| 5,580,154 | 12/1996 | Coulter et al. | 362/103 |
| 5,836,671 | 11/1998 | Chien | 362/103 |

*Primary Examiner*—Diana Oleksa
*Assistant Examiner*—Katherine Moran
*Attorney, Agent, or Firm*—Kolisch, Hartwell, Dickinson, McCormack & Heuser

[57] ABSTRACT

A signaling glove is disclosed that includes a body portion that is worn on a user's hand and at least one reflective surface mounted on the body portion. In some embodiments, the glove further includes a light source with a light-emitting unit adapted to illuminate the reflective surface. The light-emitting unit is preferably housed within a pocket formed at least in part by the reflective surface. When the light-emitting unit is housed within the pocket, the reflective surface includes a transparent or translucent region overlying the light. The reflective surface may be adjustable positionable on the body portion of the glove to enable a user to interchange the reflective surfaces and to orient the reflective surface to best fit the user's current signaling or other needs.

20 Claims, 3 Drawing Sheets

SIGNALING GLOVE

FIELD OF THE INVENTION

The invention relates generally to signaling devices, and more particularly to reflective signaling gloves.

BACKGROUND AND SUMMARY OF THE INVENTION

In the past, traffic-control and signaling personnel generally only had pole-mounted stop signs and their own body movements to rely upon to signal others and direct traffic. For example, the person's hand and arm movements could be used to direct oncoming vehicles, pedestrians, bicyclists, etc. to stop, to turn a specified direction or to proceed in their present direction. When a pole-mounted stop sign is used, the person has a larger signaling device to indicate that oncoming traffic should stop, but the person's hands are also fully-occupied holding and maintaining the sign in its operative position.

One prior attempt to improve on this original situation is a glove that includes an equilateral triangle formed from a reflective material on the palm and back of the glove. Each triangle points upwardly toward the fingers of the glove, and more particularly between the second and third fingers of the glove. The palm triangle is a reddish reflective material, which conveys to others that they should stop, and the back triangle is a yellowish reflective material. The gloves have been used for traffic-direction purposes because the upwardly oriented triangles can be used for signaling when the user points his or her hand to the side, in which case the tip of the triangle points in the direction of the user's fingers and indicates to others that they should proceed in the indicated direction. Similarly, when the user's hand is pointed so the palm faces others, the red, upwardly oriented triangle indicates that they should stop.

The above-described glove has made it more convenient for traffic-control personnel to direct traffic without having to constantly hold and position a pole-mounted stop sign. Furthermore, the glove described above has enabled such traffic-control personnel to be more visible at night when used to control vehicular traffic, where the headlights of oncoming vehicles reflect off of the reflective material on the glove to illuminate that material for better viewing by the driver of the oncoming vehicle.

Unfortunately, these signaling devices still fail to address many signaling situations. Because the gloves do not produce their own light, they are dependent upon light being shined upon them to give them the desired visibility. Therefore, they are ill-suited for use in situations where the oncoming vehicles or people do not have a forward-oriented light, such as a headlight.

Similarly, when the above-described gloves are worn by bikers, namely, riders of motorcycles, scooters, bicycles, etc., the arrows on the back of the user's hand direct traffic toward the biker instead of away from the biker. For example, when a user rides a bike with a generally straight handlebar, such as a motorcycle, scooter or mountain bike, the arrows on the gloves point generally forward of the bike in a converging path. When used by a rider of a 10-speed or similar bike with downwardly curved handlebars or a bike with an AEROBAR structure, the arrows would point almost directly toward each other. In both cases, oncoming traffic will see reflective arrows directing the traffic generally toward the bike being ridden, instead of away from the bike. Especially at night, when the rider of the bike may not be otherwise visible, this may be confusing to the oncoming motorists, who may steer in the indicated direction and toward the biker.

The present invention overcomes these drawbacks by providing a signaling glove which produces its own light, thereby eliminating the need for oncoming traffic to generate light to reflect off of the reflective material on the glove. Additionally, the present invention provides a signaling glove adapted for use by bikers to direct traffic safely away from the biker.

In brief summary, the invented glove includes a body portion that is worn on a user's hand and at least one reflective surface mounted on the body portion. In some embodiments, the glove further includes a light source with a light-emitting unit adapted to illuminate the reflective surface. The light-emitting unit is preferably housed within a pocket formed at least in part by the reflective surface. When the light-emitting unit is housed within the pocket, the reflective surface includes a transparent or translucent region overlying the light. The reflective surface may be adjustably positionable on the body portion of the glove to enable a user to interchange the reflective surfaces and to orient the reflective surface to best fit the user's current signaling or other needs.

Other objects and advantages of the present invention will become more readily apparent as the specification is read with reference to the below-described drawings.

DETAILED DESCRIPTION OF THE PREFERRED EMBODIMENTS

Figure 1:
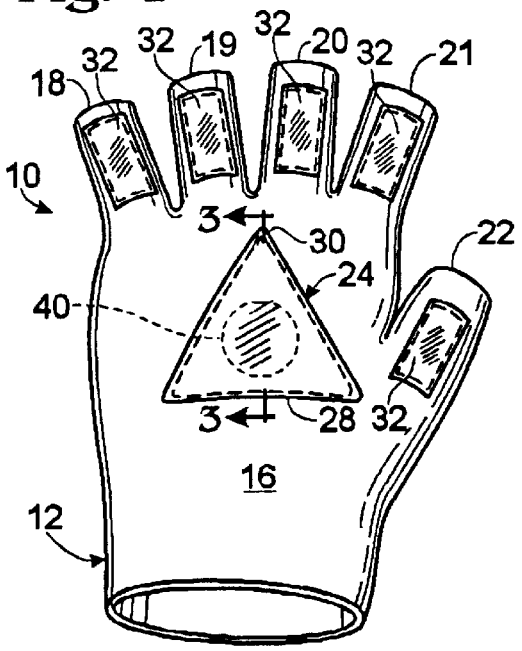
FIG. 1 is a rear elevation view of a signaling glove constructed in accordance with a first embodiment of the present invention with a light source shown in dashed lines.
Figure 2:
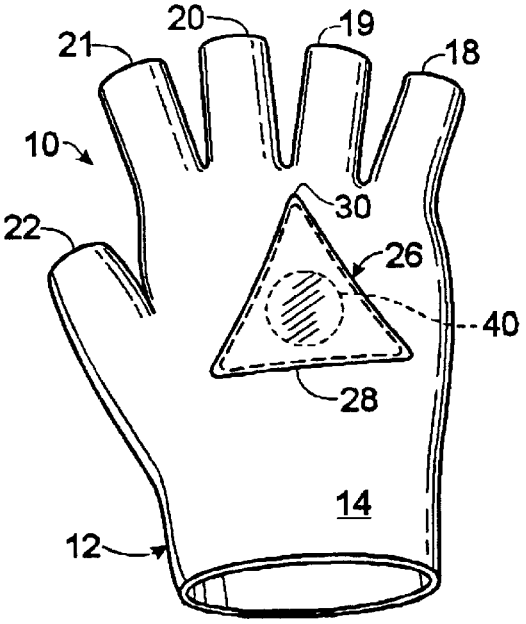
FIG. 2 is a front elevation view of the glove of FIG. 1 with a light source shown in dashed lines.

A signaling glove constructed according to a preferred embodiment of the present invention is shown in FIGS. 1 and 2 and indicated generally at 10. Glove 10 includes a glove body, or body portion, 12, which is adapted to be worn on a user's hand like a conventional glove. Body portion 12 includes a palm side 14 and a back side 16, which respectively cover portions or all of the palm and back sides of the user's hand when the glove is worn, and portion 12 may further includes finger regions 18–21 and a thumb region 22 that cover portions or all of the user's fingers and thumb.

As shown, body portion 12 further includes four truncated finger regions 18–21 and a truncated thumb region 22 that are each adapted to extend over a portion of the user's finger or thumb. Regions 18–22 are generally sized in FIGS. 1 and 2 to extend around the first digit of the finger or thumb extending from the user's hand. This enables the glove to be worn by a variety of users with different finger lengths. Glove 10 may include longer, or completely enclosed finger and thumb regions, as well as a single finger region that encloses all of a user's fingers in a single enclosure. This latter embodiment would most likely be used in cold weather, and the glove may further include an internal hand-warming disposable or reusable heat pack.

Glove 10 is preferably formed from a stretchable material that enables the glove to stretch and conform to fit over a variety of hand sizes. Additionally, the stretchable material used to form glove 10 enables the glove to be worn over other gloves. For example, in cold weather, a user may wear a first pair of gloves for warmth, and then wear the invented signaling glove 10 over the first glove. It should be understood, however, that it is within the scope of the present invention that glove 10 could come in a variety of shapes, sizes and materials. For example, it may have a mitten shape, in which the user's fingers are all housed within a common enclosed portion of the glove. Additionally, the glove may be formed from more durable materials that eliminate the need to wear the previously described glove 10 over another pair of gloves. For example, gloves may be formed from flame-, chemical- and/or water-retardant or proof materials to adapt the gloves for use in a variety of applications. Other known materials for forming protective, safety and conventional gloves, such as natural and synthetic leathers, rubber, fabric, canvas, etc. may be used as well.

Glove 10 further includes a pair of reflective surfaces 24 and 26, one mounted on each side of body portion 12. Surfaces 24 and 26 are formed from a reflective material that should be sufficiently flexible to conform to the contours of the user's hand and not restrict the user's range of motion and positions. The material may include an additional reflective backing that increases the amount of light reflected off of surfaces 24 and 26. The reflective material used to form surfaces 24 and 26 may be colored, such as florescent yellow, orange or red, and typically include a highly reflective backing covered by a transparent or translucent clear or colored layer.

Suitable materials for use in forming surfaces 24 and 26 are sold by Reflexite North America under the tradenames REFLEXITE and SUPER BRIGHT REFLEXITE. Other known reflective materials may be used as well. For example, 3M makes a variety of flexible, reflective materials sold under the tradename SCOTCHLITE which may be suitable for use in the present invention. Furthermore, because gloves 10 will often be used in emergency conditions, which tend to involve rain or snow, the material should either be waterproof or enclosed with a protective waterproof cover. Additionally, the gloves may occasionally need to be washed, so the material used for body portion 12 and all reflective surfaces should be able to be washed without losing its shape, form or properties.

As shown, surfaces 24 and 26 are in the shape of a triangle, with a base 28 adapted to extend generally across the user's hand and transverse to the user's fingers, and a tip 30 oriented toward the user's fingers. Preferably one or both of surfaces 24 and 26 include a direction-indicating portion, such as tip 30, that directs others to move in the indicated direction. It should be understood that surfaces 24 and 26 are not limited to triangles, however, and it is within the scope of the present invention that other shapes may be used as well, depending on the signaling needs of a user. For example, surfaces 24 and 26 may be shaped like arrows with tail portions extending away from the direction-indicating portions.

Additionally, in some applications, it may be desirable for one of the surfaces to have a configuration that is directed for a specific purpose or to indicate a special signal to others, such as to stop, slow, perform a specific act, etc. This signaling capacity may be increased by the reflective surfaces having regions of varying transparency or translucency, such as to form words, symbols, patterns or other meaningful indicia.

Also shown in FIGS. 1 and 2 are secondary reflective surfaces 32 that are mounted on the finger and thumb region of body portion 12 to provide additional visibility to the glove. As shown, surfaces 32 have generally rectangular configurations and generally cover the back portion of the first joint of the user's fingers and thumb extending from the hand. It should be understood, however, that the shape and size of surfaces 32 may vary and may include, for example, any suitable regular or irregular geometric shape. Surfaces 32 should be formed from one of the flexible, reflective materials described above.

In FIGS. 1 and 2, it is shown that glove 10 further includes a light source that is schematically indicated at 40. Light source 40 should include a light-emitting unit, power source and an actuator or switch for selectively turning the light source on and off. The power source, which typically is a battery, is selectively removable from glove 10 to enable it to be replaced when worn out, or preferably recharged and reused. The light-emitting unit, as its name implies, emits light which illuminates and/or reflects light off the reflective surface by which it is located to make the surface visible to others even when other light is not shined on and reflected off the surface.

Figure 3:
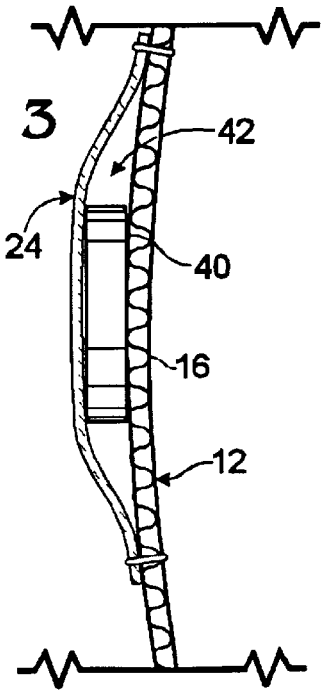
FIG. 3 is a cross-sectional detail of the glove of FIG. 1.

As shown in FIG. 3, surface 24 forms a pocket 42 with body region 12. Pocket 42 includes an opening 44 through which light source 40 may be selectively inserted into and removed from the pocket. When housed within the pocket, the light-emitting unit of light source 40 illuminates reflective surface 24 to cause it to be viewable by others. Light source 40 causes the light-emitting unit, typically an LED or bulb, to continuously or intermittently shines, strobes or pulses to generate a signal, which preferably is emitted in a wide range of directions.

In variations of the invention, light source 40 is sealed within pocket 42. In this embodiment, the glove is intended for a single or limited duration of uses. Similarly, because the light is completely enclosed within the pocket, its actuator or switch should be able to be actuated though surface 24 or body portion 12. One suitable form of switch which may be used in this or any of the other embodiments is a push-button type switch that is turned on and off by a user simply pressing on a particular region of light source 40. Another advantage of this type of switch is that it does not require precision manipulation or handling of light source 40, and therefore may be accomplished quickly by a user, even when the user is wearing a pair of thicker gloves that cover the user's fingers or when the light source is housed within the pocket.

Figure 4:
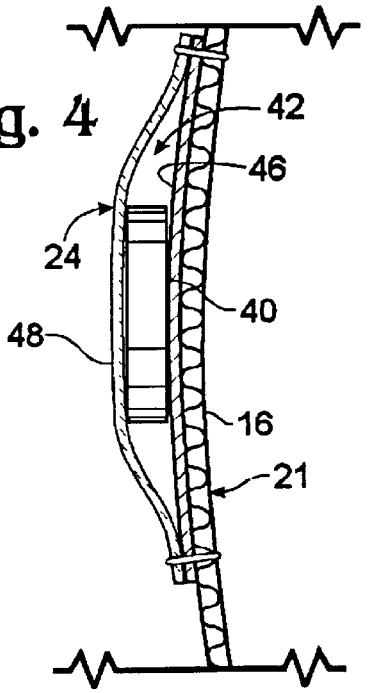
FIG. 4 is the cross-sectional detail of FIG. 3 showing an alternate embodiment of the reflective surface.
Figure 5:
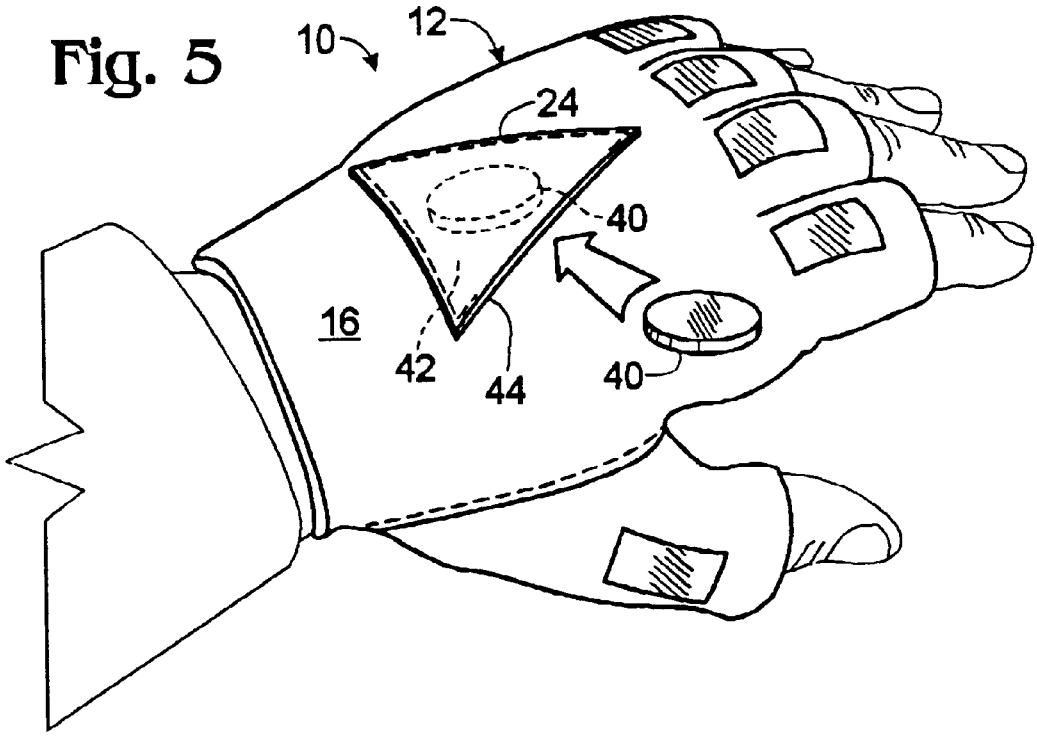
FIG. 5 is an enlarged detail showing one of the reflective surfaces mounted on the body portion of the glove to define a pocket with an opening between the surface and the body portion of the glove.

In FIG. 4 an alternate embodiment of reflective surface 24 is shown. In this embodiment, surface 24 includes an inner layer 46 that is mounted on body 12 and an outer layer 48 that overlies the side of inner layer 46 away from body 12. The layers are secured together around their perimeter regions, but pocket 42 is defined between the layers, into which light source 40 may be housed. Additionally, as shown in FIG. 4, pocket 42 may include an opening 44 so light source 40 may be selectively inserted and removed from glove 10. Preferably inner layer 46 is a highly reflective material that is adapted to reflect all light that impacts it, and outer layer 48 is at least partially transparent or translucent to enable the emitted light to pass through the layer while also illuminating the reflective surface for viewing or signaling purposes. Inner layer 46 increases the amount of light emitted outwardly from the glove because it causes light which otherwise would be partially or totally absorbed by body portion 12 to be reflected away from the glove through outer layer 48. If body portion 12 itself is formed from a reflective material, then a similar effect may be accomplished, depending on the reflectiveness of the material.

Figure 6:
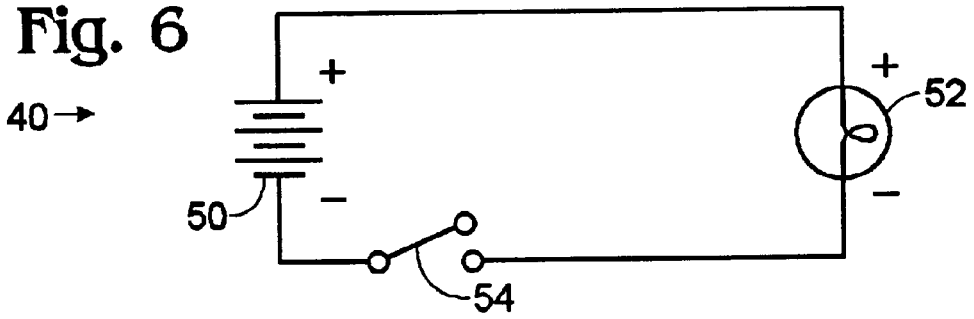
FIG. 6 is a block diagram of the light source shown in FIGS. 1 and 2.
Figure 7:
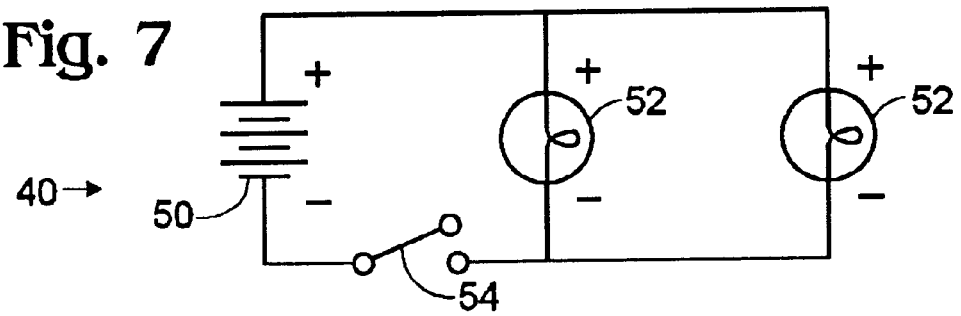
FIG. 7 is a block diagram of an alternate embodiment of the light source shown in FIGS. 1 and 2.

It should be understood that the description contained herein with respect to surface 24 also applies equally well to surface 26 and any other reflective surface on glove 10. Each reflective surface may include its own light source, which typically would have a circuit diagram similar to that shown in FIG. 6, with the power source, light-emitting unit and switch generally indicated at 50, 52 and 54, respectively. Alternatively, a single power source may provide power to a plurality of light-emitting units, each housed at least partially within our mounted adjacent a different reflective surface, including surfaces 24 and 26, secondary reflective surfaces 32 or any other reflective surface mounted on glove 10. Such a wiring diagram is schematically illustrated in FIG. 7. It should be understood that when multiple light-emitting units are powered by the same power source, the units may be connected in series or parallel, and may either include individual switches or be actuated as a unit by a single switch.

Because gloves 10 may be used in rainy or otherwise wet conditions, it is preferable that light source 40 and its component parts be waterproof or be housed within a waterproof enclosure on glove 10.

Furthermore, while surfaces 24 and 26 may either be secured in a defined orientation on body portion 12, such as in the configuration shown in FIGS. 1 and 2, or alternatively, may be retained on the glove by a selectively releasable fastening mechanism, such as a hook and loop closure structure, snaps, etc. Allowing surfaces 24 and 26 to be selectively and quickly removed and replaced without damaging body portion 12 enables the user to secure any of a variety of shapes of reflective surfaces on the glove, depending on the user's needs, tastes or moods. Additionally, the use may be able to orient the surfaces within a variety of orientations. For example, when a hook and loop or other closure mechanism is used that does not require precise orientations and positioning between the mating surfaces, the surfaces may be oriented within any radial position with respect to the mounting region on the body region of the glove, provided there is sufficient engagement between the corresponding mounting regions on the reflective surfaces and body portion 12.

Figure 8:
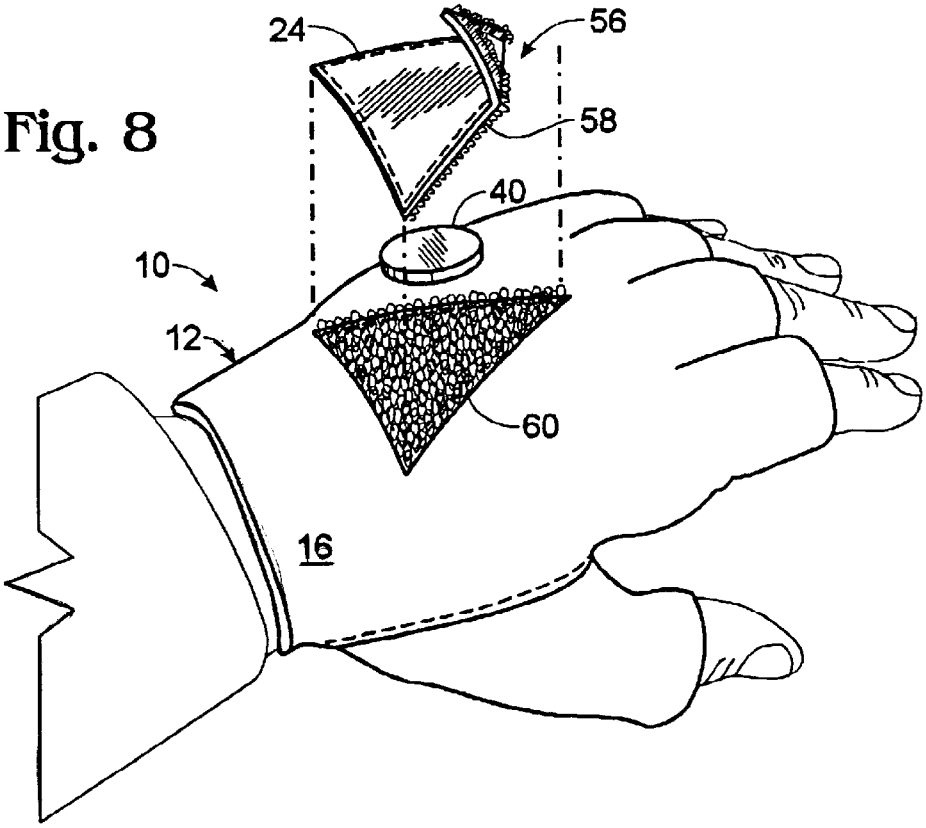
FIG. 8 is a rear elevation view of an alternate embodiment of the glove of FIG. 1.

In FIG. 8, fastening mechanism 56 includes a hook and loop closure mechanism with a first portion 58 mounted on reflective surface 24 and a second portion 60 mounted on body portion 12. Portions 58 and 60 are adapted to retain surface 24 on body portion 12 when the portions are in engagement with each other. Because portions 58 and 60 may be repeatedly engaged and removed from engagement with each other to selectively fasten and remove surface 24 and body portion 12 from each other, reflective surface 24 may be fastened to body portion 12 in a variety of radial orientations simply be removing surface 24 from portion 12, reorienting the surface with respect to portion 12, and then bringing the portions of fastening mechanism 56 on surface 24 and portion 12 back into engagement with each other. It should be understood that fastener mechanism 56 may also be used with reflective surface 26 and the secondary reflective surfaces to enable them to also be selectively removed, replaced and/or repositioned.

Figure 9:
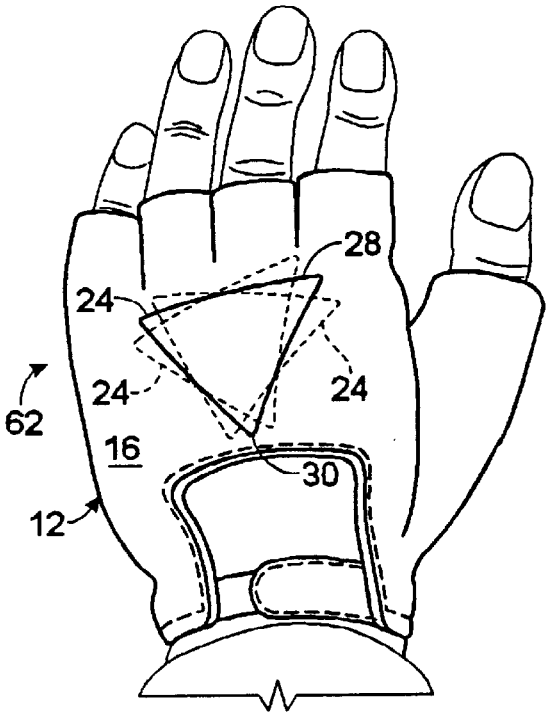
FIG. 9 is a rear elevation view of another alternate embodiment of the glove of FIG. 1.
Figure 10:
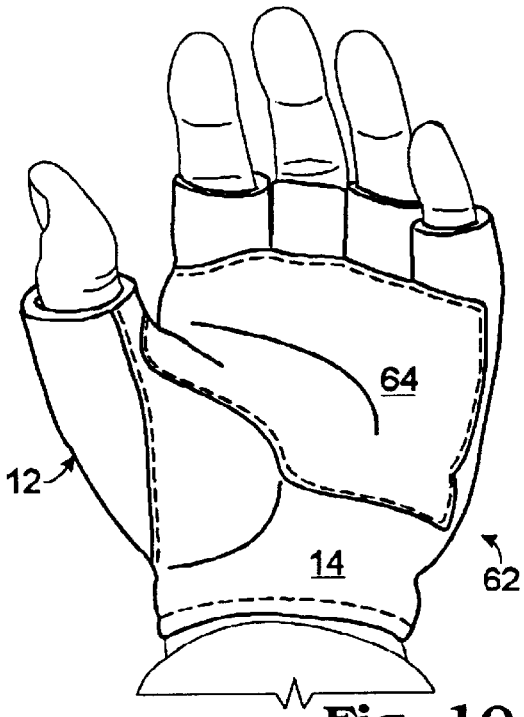
FIG. 10 is a front elevation view of the glove shown in FIG. 9.

Another embodiment of the invented signaling glove is shown in FIG. 9 and 10 and indicated generally at 62. Unless otherwise indicated, it should be understood that the embodiments include the same components and subcomponents. Glove 62 is adapted to be used by bikers and includes a body portion 12 with a back side 16 like any of the previously described embodiments in that it includes a reflective surface 24 with a direction-indicating portion. As shown in solid lines, surface 24 is shaped like a triangle, with a base 28 proximate the finger regions of body portion 12 and a direction-indicating tip 30 oriented away from the finger regions. When a biker wearing gloves 62 rides a vehicle with handlebars, like on the previously described motor and manually powered bikes, tips 30 of the surfaces are oriented generally away from each other and the user, and indicate or direct others to move in divergent paths away from the user.

To increase the safety provided by gloves 62, it is preferable that gloves 62 include at least one of the previously described light sources 40. Additionally, glove 62 may include a plurality of secondary reflective surfaces with or without light sources. Also, because bicyclists and the bikes vary in shape and size, and because bicyclists may grip the handlebars in a variety of orientations, it is preferable that reflective surface 24 is adjustably mounted on body portion 12, such as with any of the previously described fastening mechanisms. This enables the orientation of the direction indicating portion to be adjusted according to the user's hand position, such as to the orientations shown in dashed lines in FIG. 9. The orientations shown in dashed lines are shown for illustrative purposes and should not be meant to be limits on the range of orientations of surface 24 of body portion 12.

As shown in FIG. 10, palm side 16 of body portion 12 includes a pad 64 that cushions and protects the user's hand while riding and when the user falls or is otherwise knocked off the bike. Pad 64 may be formed from any suitable material conventionally used with biking and similar gloves, and may further include a reflective surface, such as previously described surface 26 mounted thereon in a secured, adjustable and/or removable manner.

While the present invention has been shown and described with reference to the foregoing preferred embodiment, it is to be understood by those of skill in the art that other changes in form and detail may be made therein without departing from the spirit and scope of the invention as defined in the following claims.

I claim:

1. A signaling glove, comprising:

a glove body adapted to be worn on a user's hand;

at least one reflective surface mounted on the body; and a light source on the body with a light-emitting unit adapted to emit light that illuminates the reflective surface.

2. The glove of claim 1, wherein the light-emitting unit is at least partially disposed between the body and the reflective surface.

3. The glove of claim 1, wherein the light-emitting unit is completely disposed between the body and the reflective surface.

4. The glove of claim 1, wherein the reflective surface defines a pocket adapted to selectively house the light source.

5. The glove of claim 4, wherein the pocket includes an inner reflective layer between the light source and the glove body, and an outer layer overlying the light source.

6. The glove of claim 5, wherein the outer layer is at least substantially transparent.

7. The glove of claim 5, wherein the light source is adapted to reflect light off of the inner reflective layer.

8. The glove of claim 1, wherein the reflective surface includes a direction-indicating portion.

9. The glove of claim 1, wherein the glove body includes a palm region and a back region opposed to the palm region, and wherein the glove includes a pair of reflective surfaces, one on the palm region and one on the back region, and wherein the light source is adapted to illuminate at least one of the reflective surfaces.

10. The glove of claim 9, wherein the light source includes plural light-emitting units, each adapted to illuminate and reflect light off of the reflective surface on the palm region or the reflective surface on the back region.

11. A signaling glove, comprising:

a glove body adapted to be worn on a user's hand and having a palm side, and a back side generally opposed to the palm side, and at least one finger portion extending from the palm and back sides;

a reflective surface mounted on the back side of the body and having a direction-indicating portion oriented generally away from the finger portion; and a fastening mechanism having a first portion mounted on the glove and a second portion mounted on the reflective surface, wherein the first and the second portions are adapted to retain the surface on the glove when the portions are in engagement and to enable the surface to be selectively removed from and remounted on the glove by removing the portions from engagement and reengaging the portions with each other.

12. The glove of claim 11, wherein the surface is arrow-shaped.

13. The glove of claim 11, wherein the direction-indicating portion has a triangular configuration, and wherein the surface further includes a tail portion extending from the direction-indicating portion in a direction generally away from the direction indicated by the direction-indicating portion.

14. The glove of claim 11, wherein the glove further includes a second reflective surface mounted on the palm side of the body.

15. The glove of claim 14, wherein the second reflective surface includes a direction-indicating portion.

16. The glove of claim 15, wherein the direction-indicating portions of the reflective surfaces are aligned.

17. The glove of claim 15, wherein the direction-indicating portions of the reflective surfaces are oriented to indicate different directions.

18. A signaling device, comprising:

a glove adapted to be worn on a user's hand;

at least one reflective surface; and a fastening mechanism having a first portion mounted on the glove and a second portion mounted on the surface, wherein the first and the second portions are adapted to retain the surface on the glove when the portions are in engagement, and to enable the surface to be selectively removed from and remounted on the glove by respectively removing the portions from engagement and reengaging the portions with each other.

19. The device of claim 18, wherein the reflective surface includes a direction-indicating portion.

20. The device of claim 18, wherein the device further includes a light source with a light-emitting unit adapted to illuminate the reflective surface.

* * * * *